US011746579B1

(12) United States Patent
Muha et al.

(10) Patent No.: US 11,746,579 B1
(45) Date of Patent: Sep. 5, 2023

(54) HINGE ASSEMBLY AND STACKABLE HINGE ASSEMBLY FOR ROTATION ABOUT AN OPENING

(71) Applicant: The Boeing Company, Chicago, IL (US)

(72) Inventors: Nicholas Muha, Haddon Township, NJ (US); Justin Fowler Rogers, Philadelphia, PA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 17/716,188

(22) Filed: Apr. 8, 2022

(51) Int. Cl.
*E05D 11/06* (2006.01)
*E05D 1/04* (2006.01)
*E05D 11/02* (2006.01)

(52) U.S. Cl.
CPC ..... *E05D 1/04* (2013.01); *E05D 11/02* (2013.01); *E05Y 2900/132* (2013.01); *E05Y 2900/531* (2013.01)

(58) Field of Classification Search
CPC . Y10T 16/5285; Y10T 16/557; Y10T 16/558; E05D 1/04; D05D 11/00; D05D 11/02; B64C 9/02; B64C 23/00; B64C 23/02; E05Y 2201/10; E05Y 2800/10; E05Y 2800/12; E05Y 2800/176; E05Y 2900/132; E05Y 2900/502; E05Y 2900/531
See application file for complete search history.

(56) References Cited

U.S. PATENT DOCUMENTS 3,740,791 A * 6/1973 Bulin ..... F16C 11/103 16/346
4,191,419 A * 3/1980 Kirkpatrick ..... A47C 4/14 16/352
4,882,807 A * 11/1989 Frye ..... B60N 2/85 16/361
5,015,026 A * 5/1991 Mouri ..... B60N 2/305 296/65.09
5,116,099 A * 5/1992 Kwasnik ..... B60N 2/75 297/411.32

(Continued)

FOREIGN PATENT DOCUMENTS

CN 103935274 A * 7/2014 ..... B60N 2/753
CN 208808587 U * 5/2019
KR 2014117866 A * 10/2014 ..... B60N 2/753

*Primary Examiner* — Chuck Y Mah
(74) *Attorney, Agent, or Firm* — Quinn IP Law

(57) ABSTRACT

A hinge assembly includes a first hinge member having an arcuate guide slot extending around a first opening and an overall thickness equal to or greater than a radial width of the arcuate guide slot, and a second hinge member having first and second clevis portions with a second opening formed through each of the clevis portions. Fastening member holes are defined in one or both clevis portions and arrayed in a first arcuate array around one or both of the second openings with a radius corresponding to the arcuate guide slot radius. The first hinge member is inserted between the clevis portions with the first and second openings aligned with each other. Fastening members extend into or through the fastening member holes and are slidably received in the arcuate guide slot so as to enable relative rotation between the hinge members about an axis passing through the first and second openings.

20 Claims, 9 Drawing Sheets

(56) References Cited

U.S. PATENT DOCUMENTS

| | | | | |
|---|---|---|---|---|
| 5,558,299 | A * | 9/1996 | Veile | B64C 3/56 244/3.28 |
| 5,956,810 | A * | 9/1999 | Spaeth | E05D 11/06 16/358 |
| 6,186,595 | B1 * | 2/2001 | Ward | B60N 2/20 297/378.1 |
| 6,353,970 | B1 * | 3/2002 | Spaeth | B60N 2/20 16/376 |
| 7,066,543 | B2 * | 6/2006 | Yu | B60N 2/0232 297/378.12 |
| 8,245,479 | B2 * | 8/2012 | Gannon | E04C 3/005 52/713 |
| 8,550,484 | B1 * | 10/2013 | Draper | B62K 21/16 280/278 |
| 8,850,774 | B2 * | 10/2014 | Kempf | E04B 1/344 52/646 |
| 9,416,945 | B2 | 8/2016 | Chung et al. | |
| 2008/0047100 | A1 * | 2/2008 | Gitnes | B64C 3/56 16/221 |
| 2008/0197256 | A1 * | 8/2008 | Hirschhorn | F16M 11/041 248/276.1 |
| 2015/0367757 | A1 * | 12/2015 | Sollars | B60N 2/2236 297/362.11 |
| 2017/0260785 | A1 * | 9/2017 | Vanini | E05F 1/1058 |
| 2018/0009088 | A1 * | 1/2018 | Gehling | B25B 13/32 |
| 2019/0321741 | A1 * | 10/2019 | Park | A63H 33/062 |
| 2020/0224819 | A1 * | 7/2020 | Chin | F16M 11/12 |

* cited by examiner

HINGE ASSEMBLY AND STACKABLE HINGE ASSEMBLY FOR ROTATION ABOUT AN OPENING

INTRODUCTION

This disclosure relates generally to hinges and hinge assemblies.

Hinges of various types may be utilized to provide rotation between two external members that are attached to the hinge. For example, one or more hinges may be used to provide relative rotation between a door and its doorframe, such as in a house, a building, an automotive vehicle, etc. As another example, a hinge or hinge-like mechanism may be used to provide relative rotation between two shafts, beams or other structural members, such as in an automotive vehicle body (e.g., a fuselage or cockpit), or in various industrial applications.

Hinges provide relative rotation of the attached members about an axis of rotation. In most hinges or hinge assemblies, a hinge pin is provided between two rotatable hinge members, with the axis of rotation being colinear with the hinge pin. However, the hinge pin, and the portions of the two hinge members attached to the hinge pin, take up space, and in some applications it may be desirable to have an open passage through this space, so that wires, cables, tubing or other elements may be passed therethrough.

SUMMARY

According to one embodiment, a hinge assembly includes: (i) a first hinge member having opposed first and second major surfaces, a first opening, an arcuate guide slot extending around a first portion of the first opening and having an arcuate guide slot radius, and an overall thickness that is equal to or greater than a radial width of the arcuate guide slot; and (ii) a second hinge member having first and second clevis portions with a respective second opening formed through each of the first and second clevis portions, and one or more fastening member holes defined in one or both of the first and second clevis portions and arrayed in a first arcuate array around one or both of the second openings, wherein the first arcuate array has a first arcuate array radius corresponding to the arcuate guide slot radius. The first hinge member is inserted between the first and second clevis portions with the first and second openings aligned with each other, and one or more fastening members extend into or through the one or more fastening member holes and are slidably received in the arcuate guide slot so as to enable relative rotation between the first and second hinge members about an axis passing through the first and second openings. The axis may also pass through a center of both the arcuate guide slot radius and the first arcuate array radius An arcuate inner wall may extend outward from each of the first and second major surfaces and may be disposed between the first opening and the arcuate guide slot, and an arcuate outer wall may extend outward from each of the first and second major surfaces and may be disposed radially outward of the arcuate guide slot. The arcuate inner and outer walls may extend to a first height outward from the first major surface and to a second height outward from the second major surface, and the overall thickness of the first hinge member may comprise the first height plus the second height plus a first thickness as measured between the first and second major surfaces. Optionally, the arcuate inner and outer walls may extend along a full arc length of the arcuate guide slot.

The one or more fastening members may include one or more raised bosses that are integrally formed on one of the first and second clevis portions and that extend through the arcuate guide slot and into or through the one or more fastening member holes defined in the other of the first and second clevis portions. Alternatively, the one or more fastening members may include one or more fasteners extending through a first plurality of the fastening member holes defined in one of the first and second clevis portions, through the arcuate guide slot, and into or through a second plurality of the fastening member holes defined in the other of the first and second clevis portions. The hinge assembly may further include one or more arcuate bushings each having a respective one or more through-holes defined therein in a second arcuate array which substantially matches the first arcuate array, wherein each arcuate bushing is disposed within the arcuate guide slot and between the first and second clevis portions, and wherein the one or more fastening members extend through the one or more through-holes.

The first hinge member may include a first connection arrangement configured for attachment to a first external member and the second hinge member may include a second connection arrangement configured for attachment to a second external member. In this configuration, the first and second clevis portions may be formed on a first side of the second hinge member and the second connection arrangement may be formed on a second side of the second hinge member opposite the first side. The second hinge member may comprise first and second sub-portions that are attached together, wherein the first sub-portion includes the first clevis portion extending therefrom and the second sub-portion includes the second clevis portion extending therefrom.

According to another embodiment, a hinge assembly includes: (i) a plate-like first hinge member having opposed first and second major surfaces, a first opening, an arcuate guide slot extending around a first portion of the first opening and having an arcuate guide slot radius, and an overall thickness that is equal to or greater than a radial width of the arcuate guide slot; and (ii) a second hinge member having first and second plate-like clevis portions with a respective second opening formed through each of the first and second clevis portions, and a plurality of fastening member holes defined in the first and second clevis portions in a first arcuate array around a respective second portion of each of the second openings, wherein the first arcuate array has a first arcuate array radius corresponding to the arcuate guide slot radius. The first hinge member is inserted between the first and second clevis portions with the first and second openings aligned with each other, and a plurality of fasteners extend through the fastening member holes and are slidably received in the arcuate guide slot so as to enable relative rotation between the first and second hinge members about an axis passing through the first and second openings and through a center of the arcuate guide slot radius and of the first arcuate array radius.

In this embodiment, an arcuate inner wall may extend outward from each of the first and second major surfaces and may be disposed between the first opening and the arcuate guide slot, and an arcuate outer wall may extend outward from each of the first and second major surfaces and may be disposed radially outward of the arcuate guide slot. The arcuate inner and outer walls may extend to a first height outward from the first major surface and to a second height outward from the second major surface, wherein the overall thickness of the first hinge member comprises the first height plus the second height plus a first thickness as measured between the first and second major surfaces. Further, the arcuate inner and outer walls may extend along a full arc length of the arcuate guide slot.

The hinge assembly may further include an arcuate bushing having a plurality of through-holes defined therein in a second arcuate array which substantially matches the first arcuate array, wherein the arcuate bushing is disposed within the arcuate guide slot and between the first and second clevis portions, and wherein the plurality of fasteners extend through the plurality of through-holes. The first hinge member may include a first connection arrangement configured for attachment to a first external member and the second hinge member may include a second connection arrangement configured for attachment to a second external member. The second hinge member may comprise first and second sub-portions that are attached together, wherein the first sub-portion includes the first clevis portion extending therefrom and the second sub-portion includes the second clevis portion extending therefrom.

According to yet another embodiment, a stackable hinge assembly includes a stackable hinge member having a sub-portion with opposed first and second sides and a clevis portion extending from the first side. The clevis portion has a distal end with a clevis opening formed therein, and one or more fastening member holes are defined in the clevis portion in a first arcuate array around a first segment of the clevis opening. In this embodiment, the sub-portion of the stackable hinge member is configured to be attached with one or more other sub-portions of other stackable hinge members so as to form a stacked hinge member arrangement.

The stackable hinge assembly may also include one or more additional stackable hinge members, for a total of N stackable hinge members, wherein the respective sub-portions of the N stackable hinge members are attached together so as to form the stacked hinge member arrangement with N clevis portions extending therefrom and N clevis openings being provided in registration with each other. The stackable hinge assembly may further include N−1 lug members each respectively having opposed first and second major surfaces, a lug opening, an arcuate guide slot extending around a second segment of the lug opening and having an arcuate guide slot radius, and an overall thickness that is equal to or greater than a radial width of the arcuate guide slot, wherein a total of N−1 lug openings and N−1 arcuate guide slots are provided. Each of the N−1 lug members may be inserted between a respective neighboring pair of the N clevis portions, such that the N clevis openings and the N−1 lug openings are aligned with each other. One or more fastening members may extend into or through the one or more fastening member holes of at least some of the N stackable hinge members and may be slidably received in the arcuate guide slots of the N−1 lug members so as to enable relative rotation between the N stackable hinge members and the N−1 lug members about an axis passing through the clevis openings and lug openings. The stackable hinge assembly may further include one or more arcuate bushings, each having a respective one or more through-holes defined therein in a second arcuate array which substantially matches the first arcuate array. Each arcuate bushing may be disposed within a respective one of the N−1 arcuate guide slots and between a respective neighboring pair of the N clevis portions, with the one or more fastening members extending through the one or more through-holes.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
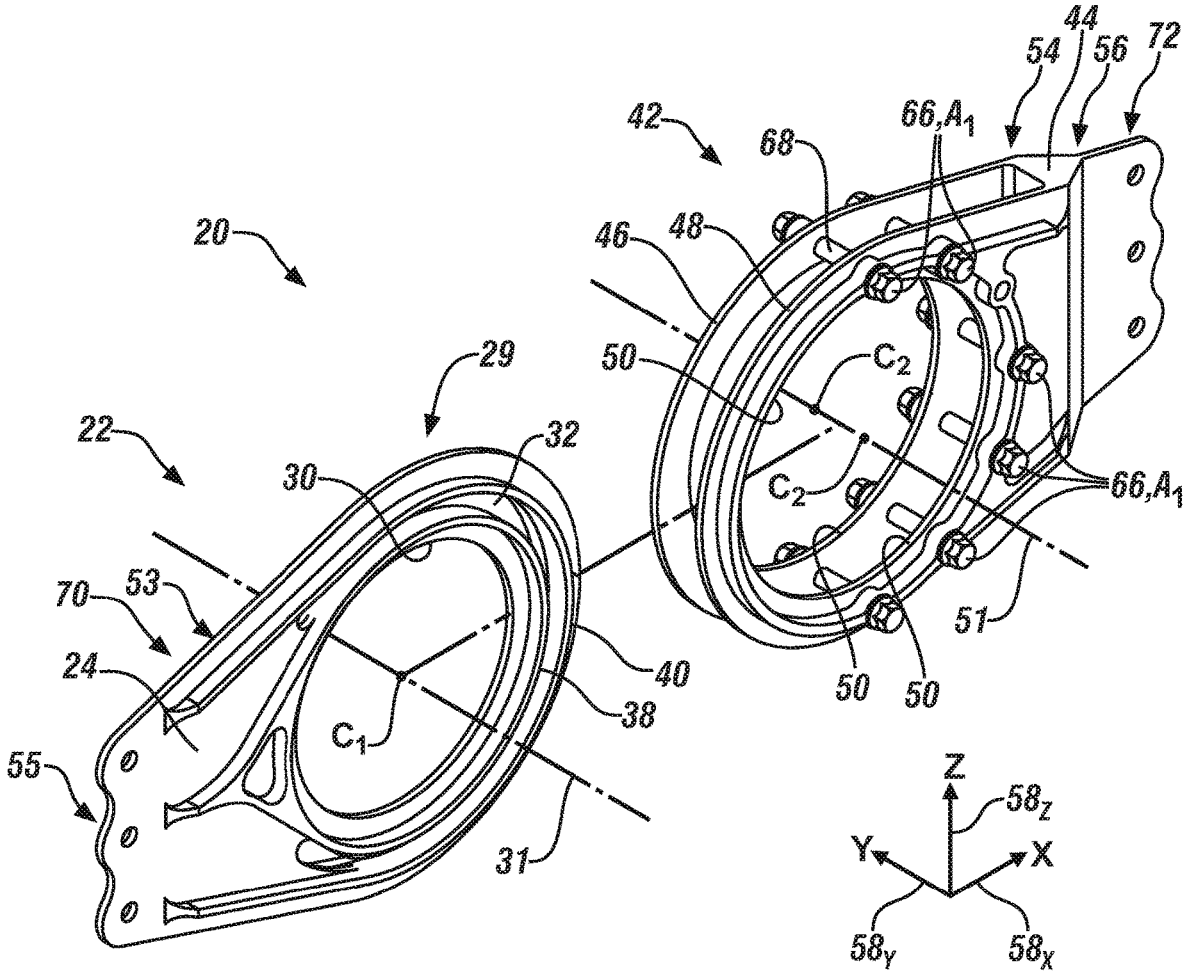
FIG. 1 is a partially exploded perspective view of a hinge assembly.

Referring now to the drawings, wherein like numerals indicate like parts in the several views, a hinge assembly 20, as well as a stackable hinge assembly 120, are shown and described herein.

The hinge assembly 20 includes first and second hinge members 22, 42 which fit together in such a way that the hinge members 22, 42 may both rotate about a common axis of rotation 71, and yet a sizeable opening or passage 90 through both members 22, 42 may be provided in the space surrounding the axis of rotation 71. In similar fashion, the stackable hinge assembly 120 utilizes N−1 lug members 22 and N stackable hinge members 130, 140 which fit together in such a way that the members 22, 130, 140 may rotate independently of one another about a common axis of rotation 71, and yet a sizeable opening or passage 90 through the members 22, 130, 140 may be provided in the space surrounding the axis of rotation 71. Two external members 10, 12 may be attached to the hinge assembly 20, and two or more external members 10, 12, 14 may be attached to the stackable hinge assembly 120, thereby enabling the attached external members to be independently rotated with respect to each other about the common rotation axis 71, while providing an empty space or opening 90 through which wires, cables, tubing or other elements may be passed. These embodiments solve one more of the technical problems faced when using other hinges or hinge-like mechanisms, by the technical effect of (i) providing an open passage 90 through the axis of rotation 71 of a hinge or hinge-like mechanism, and (ii) providing improved robustness and load carrying capability around the hoop sections of the lug/clevis portions 29, 46, 48 (due to the overall thickness T of each first hinge member 22 being equal to or greater than the radial width $W_{32}$ of an arcuate guide slot 32 formed in the first hinge member 22), as well as other technical effects described and illustrated herein, which thereby provide one or more technical advantages over other known approaches.

Figure 2:
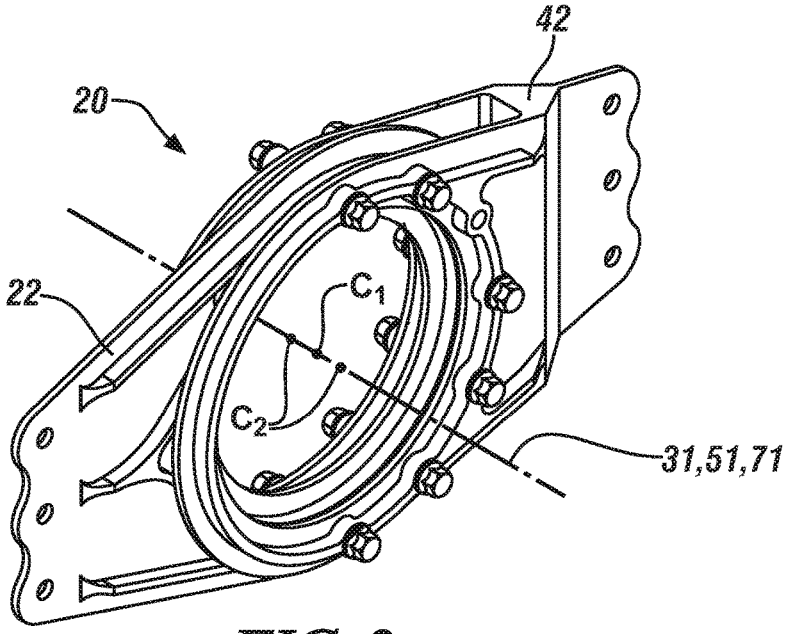
FIG. 2 is an assembled perspective view of the hinge assembly.
Figure 3:
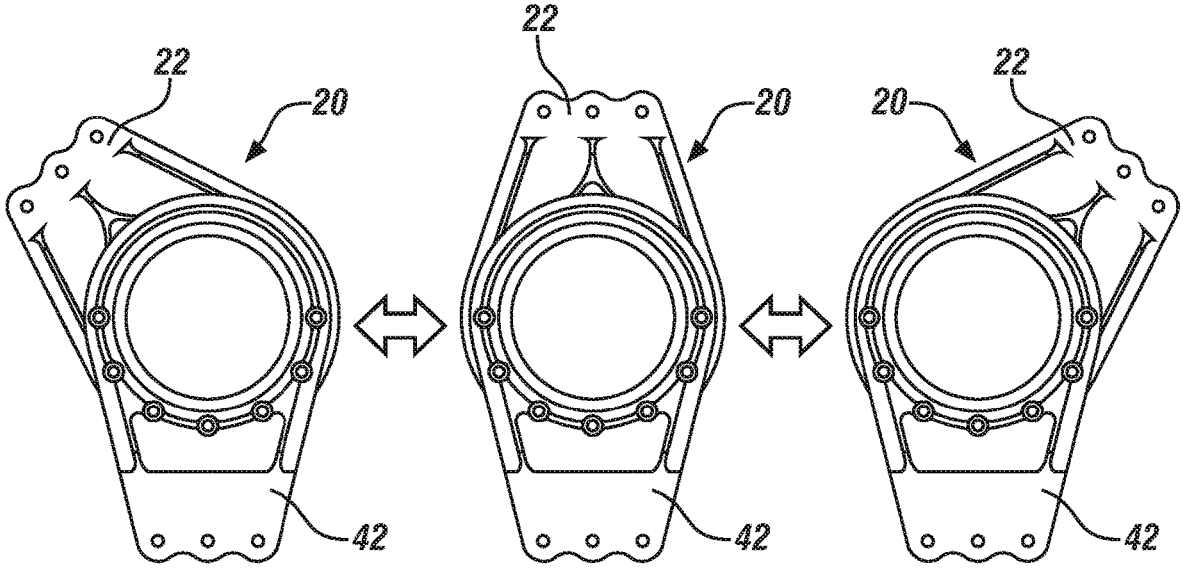
FIG. 3 shows a sequence of elevation views of the hinge assembly, illustrating the range of rotation between the first and second hinge members.
Figure 4:
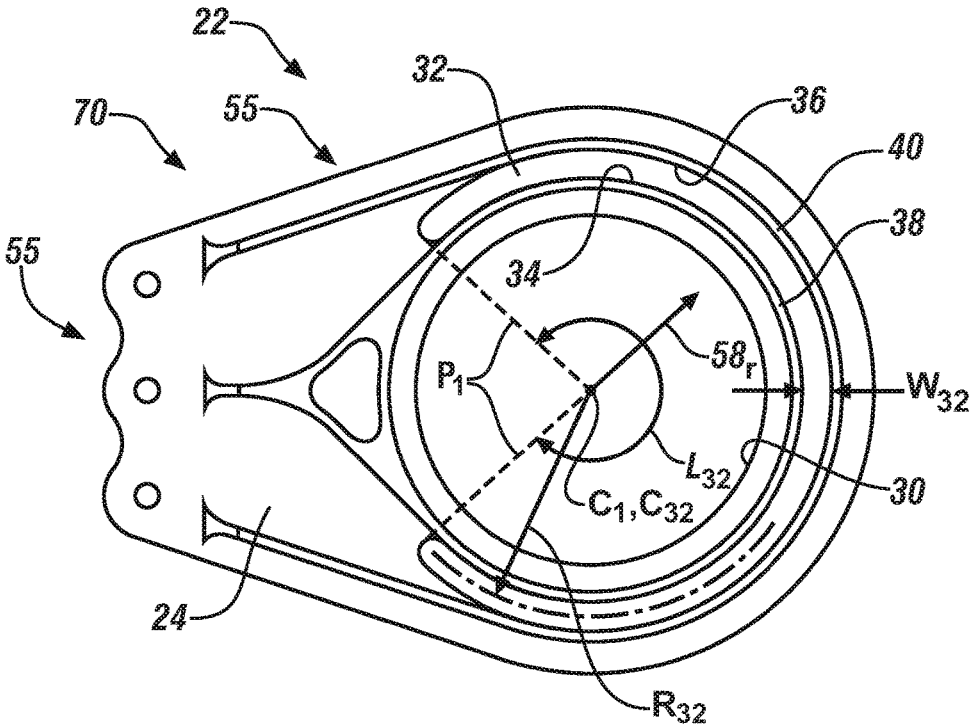
FIG. 4 is an elevation view of the first hinge member.
Figure 5:
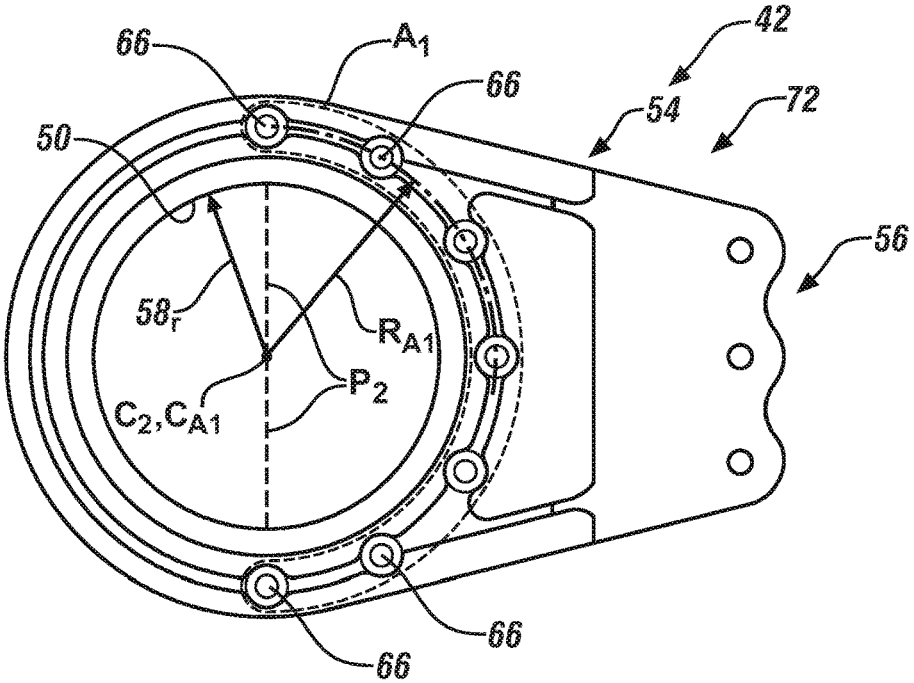
FIG. 5 is an elevation view of the second hinge member.
Figure 6A:
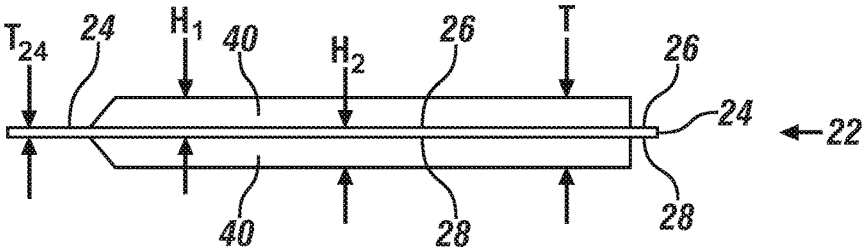
FIG. 6A-C are plan views of the first hinge member alone, the second hinge member alone and the first and second hinge members assembled together, respectively.
Figure 6B:
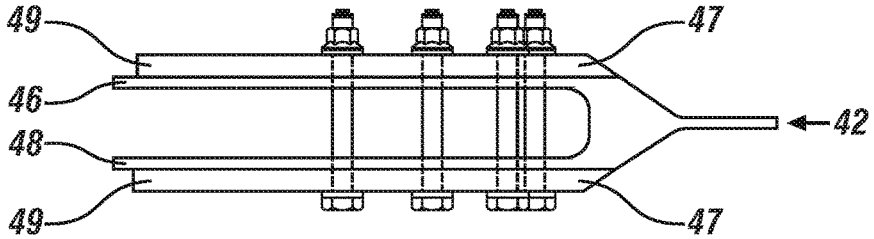
Figure 6C:
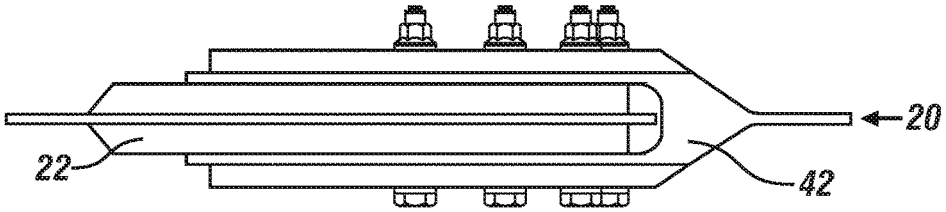
Figure 7:
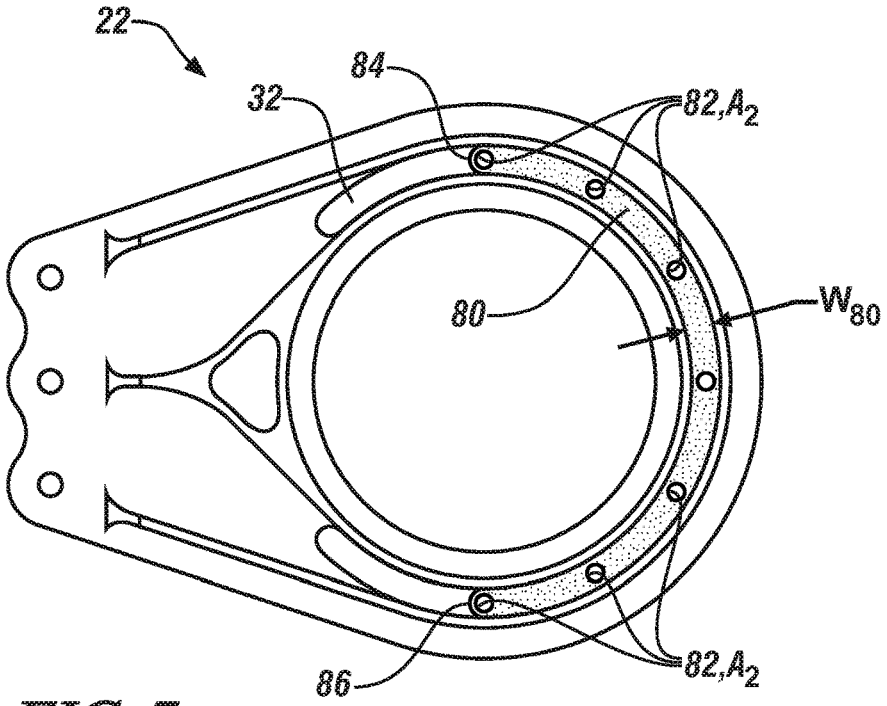
FIG. 7 is an elevation view of the first hinge member and an arcuate bushing disposed within the arcuate guide slot.
Figure 8:
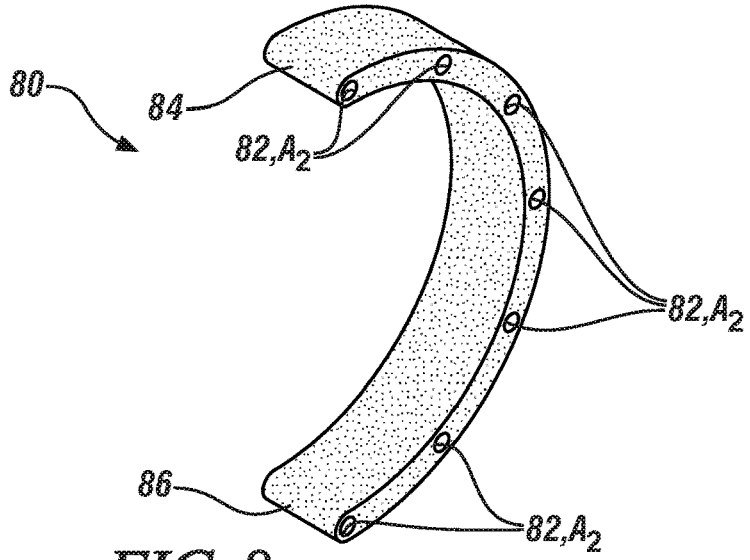
FIG. 8 is a perspective view of the arcuate bushing.
Figure 9:
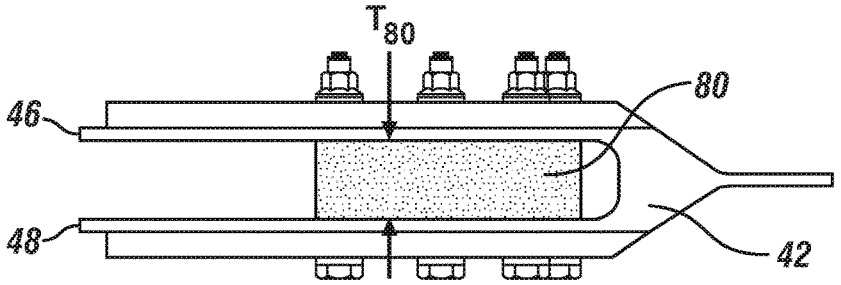
FIG. 9 is a plan view of the second hinge member with the arcuate bushing assembled and fastened therewithin.
Figure 10:
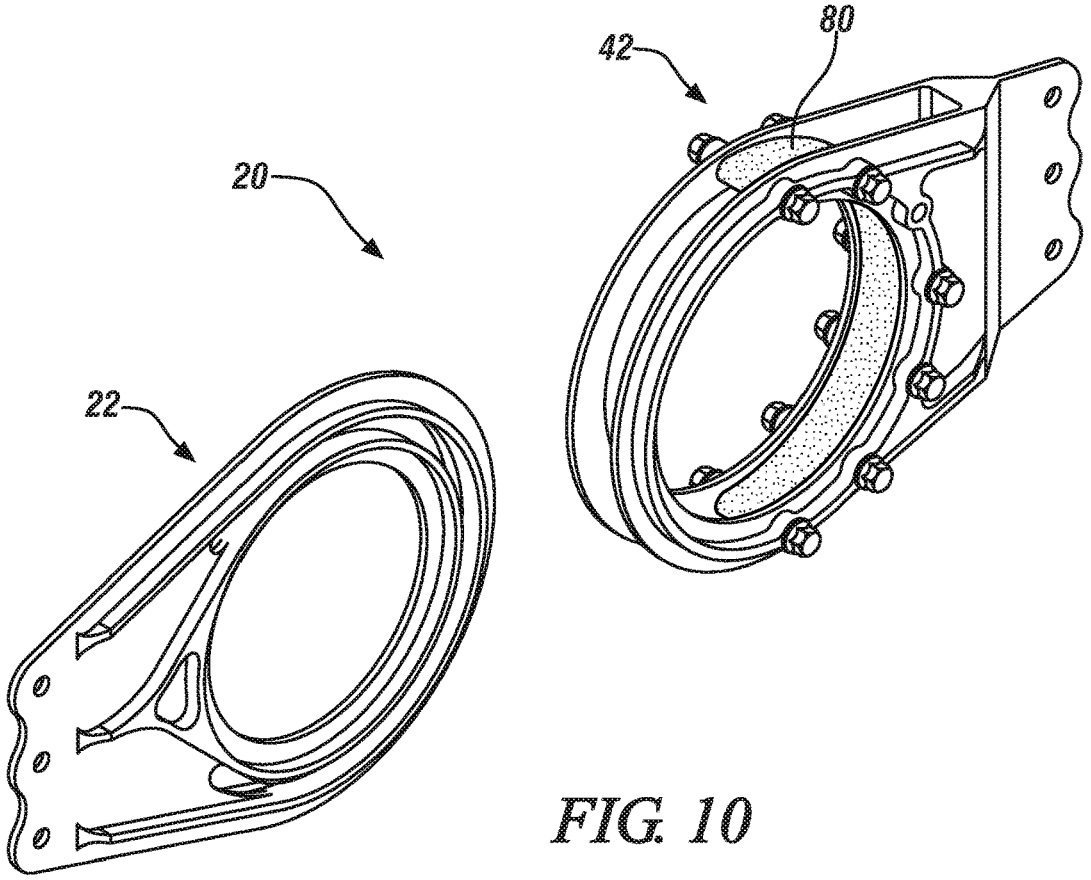
FIG. 10 is a partially exploded perspective view of the hinge assembly with the arcuate bushing assembled into the second hinge member.

FIG. 1 shows a partially exploded perspective view of the hinge assembly 20, with the first and second hinge members 22, 42 not assembled with each other. FIG. 2 shows the hinge assembly 20 in an assembled state, and FIG. 3 shows sequence of elevation views of the hinge assembly 20 illustrating the range of rotation between the first and second hinge members 22, 42. Further, FIGS. 4-5 show elevation views of the first and second hinge members 22, 42 separately, while FIGS. 6A-C show plan views of the first hinge member 22 alone, the second hinge member 42 alone and the first and second hinge members 22, 42 assembled together, respectively. FIG. 1 also shows a coordinate system in which the x-direction represents a longitudinal direction $\mathbf{58}_x$, the y-direction represents a thickness direction $\mathbf{58}_y$, and the z-direction represents a lateral or transverse direction $\mathbf{58}_z$, and FIGS. 4-5 show a radial direction $\mathbf{58}_r$ extending radially outward from each of the first and second centers $C_1$, $C_2$.

The first hinge member 22 (which may also be referred to as a "lug member") has a first body portion 24, opposed first and second major surfaces 26, 28, and a first opening 30 through the first body portion 24, thereby forming a lug portion 29 on a first side 53 of the body portion 24, with a first connection arrangement 70 formed on a second side 55 of the first hinge member 22 opposite the first side 53. As illustrated, the opening 30 may be circular and may have a first center $C_1$ with a first central axis 31 running through the first center $C_1$, but it may also assume any other shape. An arcuate guide slot 32 is formed in the first body portion 24 and extends around a first portion $P_1$ of the first opening 30. The arcuate guide slot 32 has an arcuate inner side 34 and an arcuate outer side 36, with both sides 34, 36 running parallel to each other and being separated by a radial width $W_{32}$. The arcuate guide slot 32 also has an arcuate guide slot radius $R_{32}$ (running from a center $C_{32}$ of the arcuate guide slot radius $R_{32}$, which may be coincident with the first center $C_1$, to an arc that is radially half-way between the arcuate inner and outer sides 34, 36), and the first hinge member 22 has an overall thickness T that is equal to or greater than the radial width $W_{32}$ of the arcuate guide slot 32 (i.e., $T \geq W_{32}$).

The second hinge member 42 (which may also be referred to as a "clevis member") has a second body portion 44 with first and second clevis portions 46, 48 extending outward from a first side 54 of the second body portion 44, with a respective second opening 50 formed through each of the first and second clevis portions 46, 48. Each clevis portion 46, 48 has a respective base end 47 where it extends from the second body portion 44, and a respective distal end 49 opposite the base end 47; thus, the second openings 50 may be formed in the respective distal ends 49 of the clevis portions 46, 48. A second connection arrangement 72 may be formed on a second side 56 of the second hinge member 42 opposite the first side 54. The two second openings 50 may be the same size and shape as each other, and may be the same size and shape as the first opening 30 in the first hinge member 22. As illustrated, the second openings 50 may be circular and may each have a respective second center $C_2$ with a second central axis 51 running through both of the second centers $C_2$, but the openings 50 may also assume any other shape.

One or more fastening member holes 52 are defined in one or both of the first and second clevis portions 46, 48 with the fastening member hole(s) 52 being arrayed, disposed and/or arranged in a first arcuate array $A_1$ around one or both of the second openings 50. (I.e., if the one or more fastening member holes 52 are defined in only one of the clevis portions 46, 48, then there will be only one first arcuate array $A_1$ for that one set of one or more fastening member holes 52; but if the one or more fastening member holes 52 are defined in both of the clevis portions 46, 48, then there will be a respective first arcuate array $A_1$ for each of the two sets of one or more fastening member holes 52 for a total of two first arcuate arrays $A_1$.) Each first arcuate array $A_1$ has a first arcuate array radius $R_{A1}$ (running from a center $C_{A1}$ of the first arcuate array radius $R_{A1}$, which may be coincident with a respective one of the first and second centers $C_1$, $C_2$), with the first arcuate array radius $R_{A1}$ corresponding to or matching the arcuate guide slot radius $R_{32}$.

Each fastening member hole 52 may be a through-hole which extends through the entire thickness of the respective clevis portion 46, 48 in which the hole 52 is formed, or it may be a blind hole, pocket or depression which extends through only a portion of the thickness of the respective clevis portion 46, 48 in which the hole 52 is formed. Also, each fastening member hole 52 may be a round/circular hole, a square/rectangular hole, an arcuately shaped slot, or any other shape which is suitable for receiving a corresponding fastening member 66 therein. Considerations such as (i) whether the holes 52 are formed in one or both clevis portions 46, 48, (ii) how many holes 52 (e.g., 0, 1, or more than 1) are formed in each clevis portion 46, 48, (iii) whether each fastening member hole 52 is a through-hole or a blind hole, (iv) the shape of each hole 52, and (v) the spatial arrangement and spacing of the holes 52 will depend on the type, number and arrangement of the fastening members 66 used, as described in further detail below.

The two hinge members 22, 42 are sized, shaped and configured such that the first hinge member 22 may be inserted between the first and second clevis portions 46, 48 of the second hinge member 42, with the first and second openings 30, 50 aligned or registered with each other, thereby providing a common opening or passage 90 through both hinge members 22, 42. By "aligned" or "registered", it is meant that the respective central axes 31, 51 of the first and second openings 30, 50 are colinear with each other. This colinear alignment or registration causes the two central axes 31, 51 to also serve as a common axis of rotation 71 about which the hinge members 22, 42 may be rotated.

One or more fastening members 66 are disposed so as to extend into or through the one or more fastening member holes 52, such that the fastening members 66 are slidably received within the arcuate guide slot 32, thereby enabling relative rotation between the first and second hinge members 22, 42 about the common axis of rotation 71 which passes through the first and second openings 30, 50. Each fastening member 66 may optionally include a roller bearing 68 which extends through the arcuate guide slot 32 when the hinge assembly 20 is assembled. The axis of rotation 71 may also pass through the center $C_{32}$ of the arcuate guide slot radius 32 and the center $C_{A1}$ the first arcuate array radius $R_{A1}$.

Figure 11:
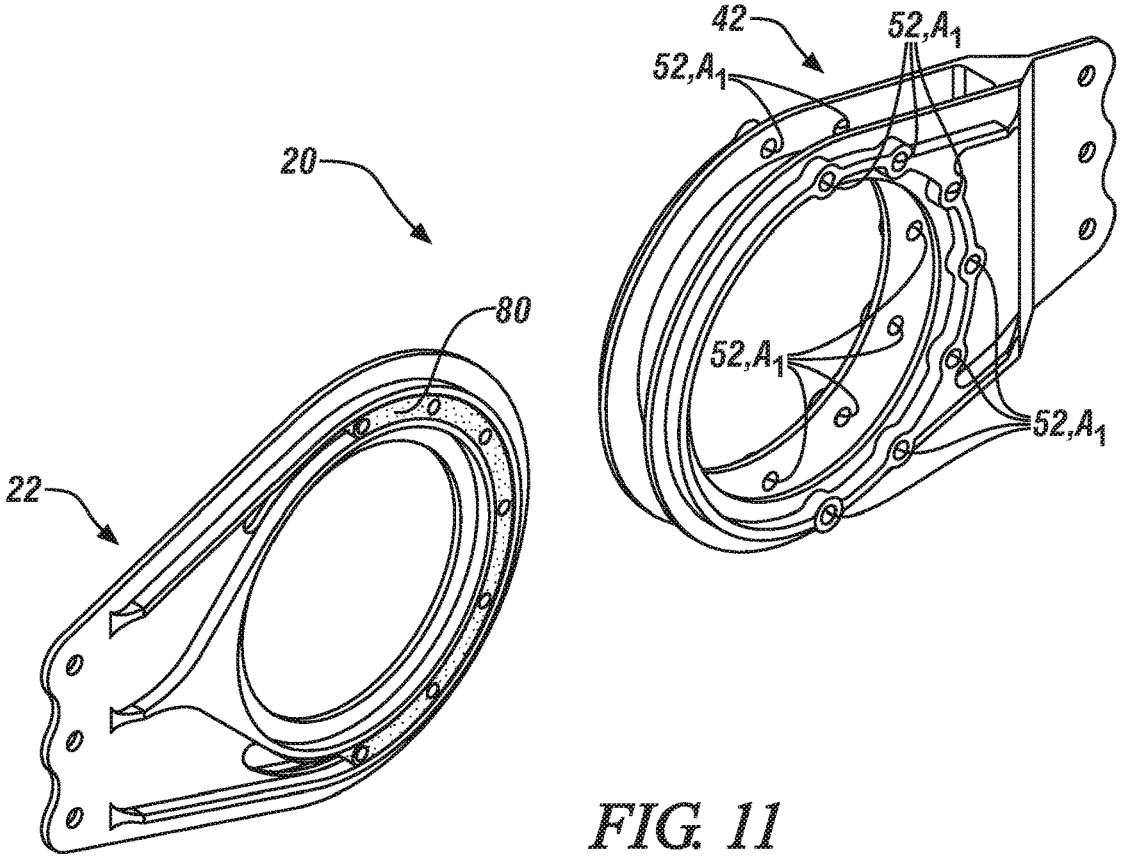
FIG. 11 is a partially exploded perspective view of the hinge assembly with the arcuate bushing disposed within the arcuate guide slot of the first hinge member and without any fastening members.
Figure 12:
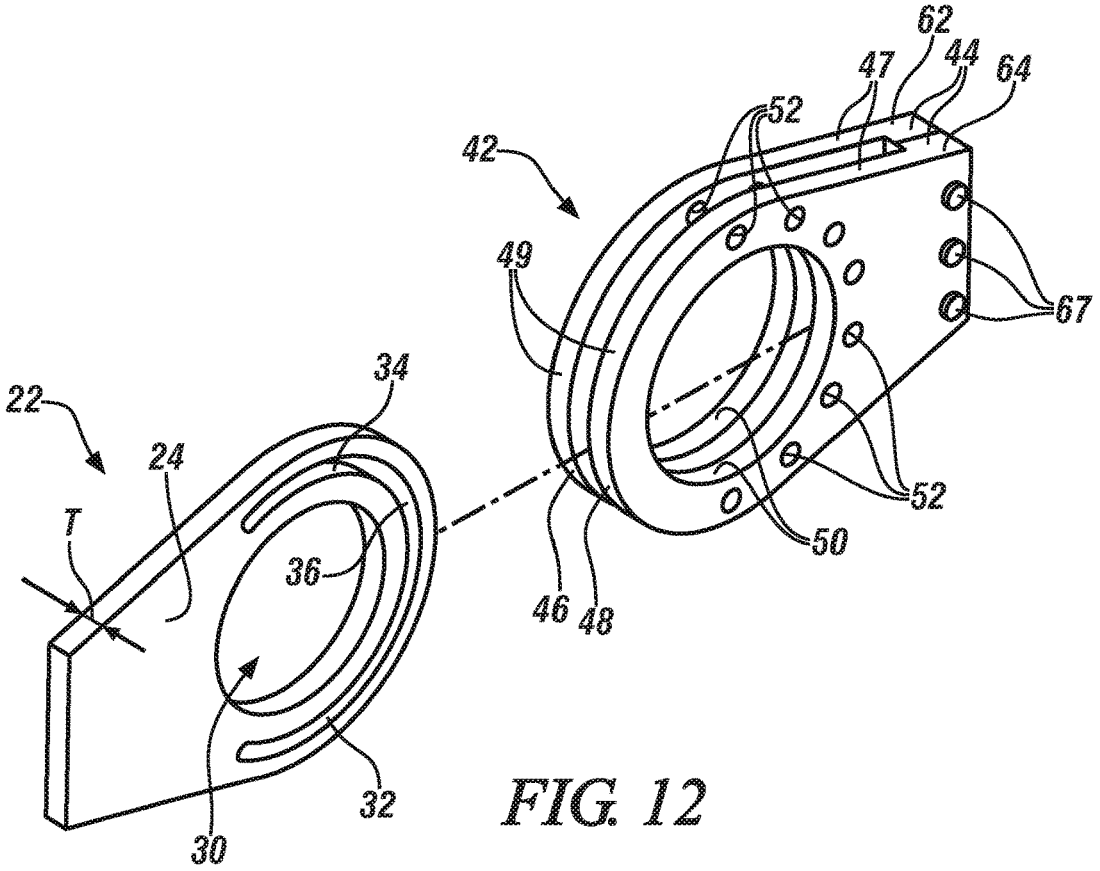
FIG. 12 is a partially exploded perspective view of another embodiment of the hinge assembly without any fastening members.

As alluded to above, the one or more fastening members 66 (and the corresponding fastening member holes 52) may assume various configurations. For example, in one configuration, the one or more fastening members 66 may comprise a plurality of conventional fasteners such as bolts and nuts. In this configuration, the fastening member holes 52 may be circular through-holes which are formed in both clevis portions 46, 48 (as shown in FIG. 11), with the bolts fed through one clevis portion 48, then through the arcuate guide slot 32 of the first hinge member 22, and then through the other clevis portion 46, and with the nuts threaded onto the end of each bolt (as shown in FIGS. 6B-C).

In this configuration, one or more optional arcuate bushings 80 may be inserted into the arcuate guide slot 32, as illustrated in FIGS. 7-11. Each arcuate bushing 80 may have one or more through-holes 82 defined therethrough, with the through-holes 82 being arrayed, disposed or arranged in a second arcuate array $A_2$ which substantially matches or corresponds to the first arcuate array $A_1$ of the fastening member holes 52. (I.e., some or all of the second arcuate array $A_2$ matches some or all of the first arcuate array $A_1$, with regard to how their respective fastening member holes 52 and through-holes 82 are located, spaced, sequenced and/or spatially arranged.)

As illustrated in the drawings, a single arcuate bushing 80 may be used whose opposed first and second bushing ends 84, 86 extend far enough around the first and second openings 30, 50 so that all of the required through-holes 82 are formed within the single arcuate bushing 80. Alternatively, two or more smaller arcuate bushings 80 may be used instead of a single larger bushing 80. When the hinge assembly 20 is assembled, each arcuate bushing 80 may be disposed within the arcuate guide slot 32 and between the first and second clevis portions 46, 48, with one or more fastening members 66 extending through the one or more through-holes 82 formed in the bushing 80. Each arcuate bushing 80 may be made of a self-lubricating material, such as polytetrafluoroethylene (PTFE), and may have a radial width $W_{80}$ that is dimensioned so as to snugly but slidably fit within the radial width $W_{32}$ of the arcuate guide slot 32, as well as a thickness Tso that is dimensioned so as to snugly but slidably fit between the two clevis portions 46, 48, so as to support the two hinge members 22, 42 and to enable them to rotate smoothly and freely about their common axis of rotation 71.

In another configuration, the one or more fastening members 66 may take the form of raised bosses, each of which is integrally formed on an interior surface of one of the first and second clevis portions 46, 48 and extends outward or away from that interior surface. For example, each raised boss fastening member 66 may be molded, machined or 3D-printed as a circular peg, or as an arcuate ridge, or as any other suitable shape that will fit within the arcuate guide slot 32. When a hinge assembly 20 using this configuration is assembled, each raised boss fastening member 66 extends from an interior surface of one of the clevis portions 46, 48, then through the arcuate guide slot 32, and then into or through a correspondingly shaped fastening member hole 52 defined in the other or opposite clevis portion 46, 48. Note that the one or more optional arcuate bushings 80 may also be used in this configuration as well.

In some embodiments, such as illustrated in FIGS. 1-7 and 10-11, an arcuate inner wall 38 may extend outward from each of the first and second major surfaces 26, 28 and may be disposed or situated between the first opening 30 and the arcuate guide slot 32, and an arcuate outer wall 40 may extend outward from each of the first and second major surfaces 26, 28 and may be disposed radially outward of the arcuate guide slot 32. The arcuate inner and outer walls 38, 40 may extend to a first height $H_1$ outward from the first major surface 26 and to a second height $H_2$ outward from the second major surface 28, and each of these heights $H_1$, $H_2$ may be substantially the same as one another (e.g., $H_1=H_2$). In this embodiment, the overall thickness T of the first hinge member 22 may comprise the first height $H_1$ plus the second height $H_2$ plus a first thickness $T_{24}$ of the first body portion 24 as measured between the first and second major surfaces 26, 28 (i.e., $T=H_1+H_2+T_{24}$). Optionally, the arcuate inner and outer walls 38, 40 may extend along a full arc length $L_{32}$ of the arcuate guide slot 32, as well as beyond the ends of the arcuate guide slot 32.

The first hinge member 22 may include a first connection arrangement 70 configured for attachment to a first external member 10, and the second hinge member 42 may include a second connection arrangement 72 configured for attachment to a second external member 12. The first and second connection arrangements 70, 72 may be provided in a wide variety of different forms. For example, as illustrated in FIGS. 1-5, 7 and 10-11, the connection arrangements 70, 72 may comprise a plurality of holes which may be used along with threaded fasteners (not shown) to secure external members 10, 12 to the hinge assembly 20. Other configurations of the connection arrangements 70, 72 may include various forms of internally threaded elements, externally threaded elements, sockets, latches, hubs, etc.

Figure 13:
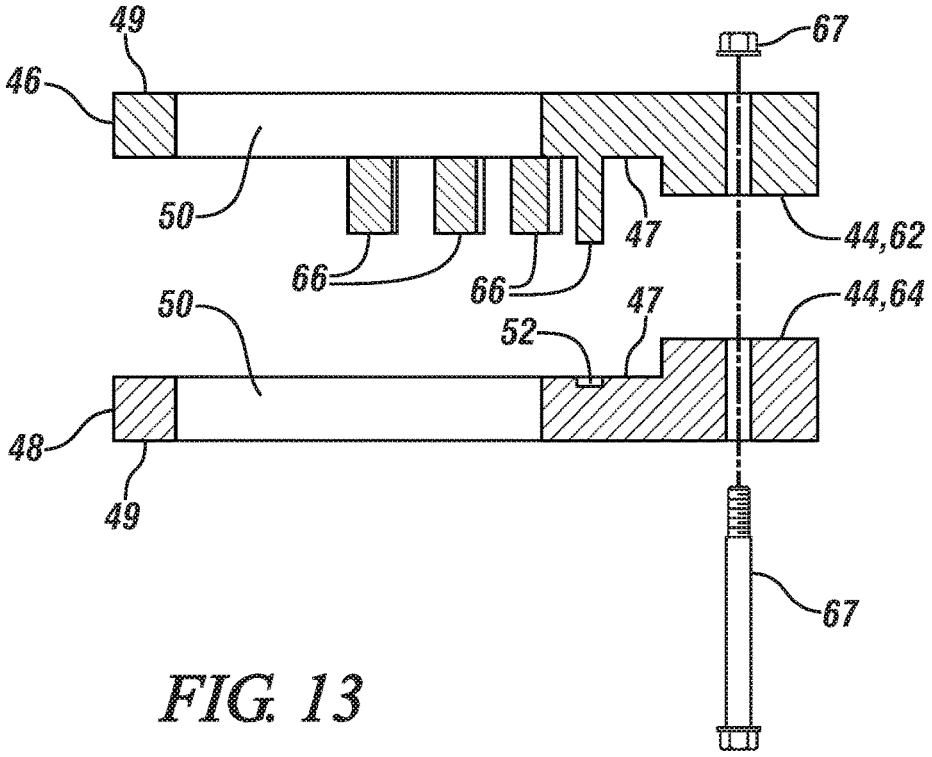
FIG. 13 is an exploded cross-sectional plan view of the second hinge member of FIG. 12 in which the fastening members are arcuate raised bosses.
Figure 14:
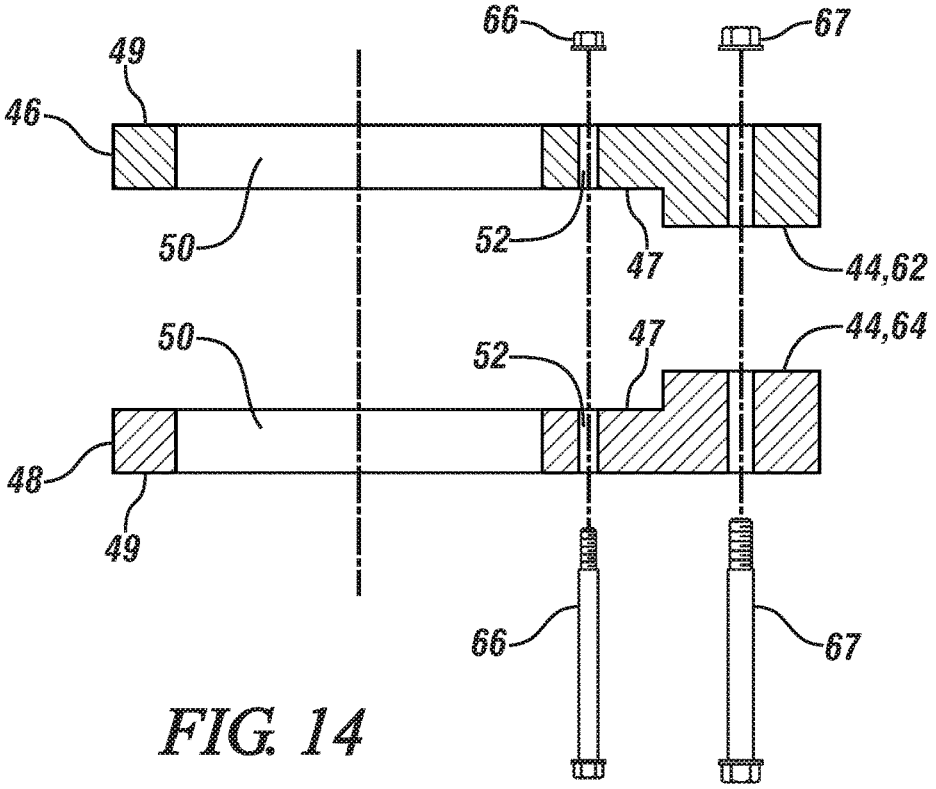
FIG. 14 is an exploded cross-sectional plan view of the second hinge member of FIG. 12 in which the fastening members are bolts and nuts.

Turning now to FIGS. 13-14, another embodiment is shown in which the second hinge member 42 may comprise separate first and second sub-portions 62, 64 that are assembled and attached together, such as by bolts and nuts or other suitable fasteners 67. In this embodiment, the first sub-portion 62 includes the first clevis portion 46 extending therefrom, and the second sub-portion 64 includes the second clevis portion 48 extending therefrom. This embodiment may be viewed as providing a "split" second hinge member 42, or a second hinge member 42 in which the second body portion 44 (and/or the entire second hinge member 42) may be split into two halves or sub-portions 62, 64. This embodiment also enables multiple sub-portions 62, 64 to be stacked or ganged together to form a second hinge member 42 which has two or more clevis portions 46, 48. In such a stacked or ganged arrangement of the second hinge member 42, multiple first hinge members 22 may be combined with the stacked or ganged arrangement of second hinge member 42 in order to provide a stacked or ganged hinged assembly 20 having more than one first hinge member 22 and more than two clevis portions 46, 48. This stacked or ganged arrangement will be discussed in yet another embodiment further below.

Note that in FIG. 13, the one or more fastening members 66 include a plurality of arcuate raised ridges extending from an interior surface of the first sub-portion 62, and the one or more fastening member holes 52 include a plurality of blind-holes or pockets formed in the second sub-portion 64 whose size, shape and arrangement correspond to the size, shape and arrangement of the arcuate raised ridges. In comparison, FIG. 14 shows the one or more fastening members 66 being a plurality of conventional threaded bolts which extend through a plurality of fastening member holes 52 configured as through-holes, with the size, shape and arrangement of the fastening member holes 52 matching that of the fastening members 66.

According to another embodiment, the hinge assembly 20 may include: (i) a plate-like or plate-shaped first hinge member 22 having opposed first and second major surfaces 26, 28, a first opening 30, an arcuate guide slot 32 extending around a first portion $P_1$ of the first opening 30 and having an arcuate guide slot radius $R_{32}$, and an overall thickness T that is equal to or greater than a radial width $W_{32}$ of the arcuate guide slot 32; and (ii) a second hinge member 42 having first and second plate-like clevis portions 46, 48 with a respective second opening 50 formed through each of the first and second clevis portions 46, 48, and a plurality of fastening member holes 52 defined in the first and second clevis portions 46, 48 in a first arcuate array $A_1$ around a respective second portion $P_2$ of each of the second openings 50, wherein the first arcuate array $A_1$ has a first arcuate array radius $R_{A1}$ corresponding to the arcuate guide slot radius $R_{32}$. The first hinge member 22 is inserted between the first and second clevis portions 46, 48 with the first and second openings 30, 50 aligned with each other, and a plurality of fasteners 66 extend through the fastening member holes 52 and are slidably received in the arcuate guide slot 32 so as to enable relative rotation between the first and second hinge members 22, 42 about an axis 71 passing through the first and second openings 30, 50 and through a center of the arcuate guide slot radius $R_{32}$ and of the first arcuate array radius $R_{A1}$.

In this embodiment, an arcuate inner wall 38 may extend outward from each of the first and second major surfaces 26, 28 and may be disposed between the first opening 30 and the arcuate guide slot 32, and an arcuate outer wall 40 may extend outward from each of the first and second major surfaces 26, 28 and may be disposed radially outward of the arcuate guide slot 32. The arcuate inner and outer walls 26, 28 may extend to a first height $H_1$ outward from the first major surface 26 and to a second height $H_2$ outward from the second major surface 28, wherein the overall thickness T of the first hinge member 22 comprises the first height $H_1$ plus the second height $H_2$ plus a first thickness $T_{24}$ as measured between the first and second major surfaces 26, 28. Further, the arcuate inner and outer walls 38, 40 may extend along a full arc length $L_{32}$ of the arcuate guide slot 32.

The hinge assembly 20 may further include an arcuate bushing 80 having a plurality of through-holes 82 defined therein in a second arcuate array $A_2$ which substantially matches the first arcuate array $A_1$, wherein the arcuate bushing 80 is disposed within the arcuate guide slot 32 and between the first and second clevis portions 46, 48, and wherein the plurality of fasteners 66 extend through the plurality of through-holes 82. The first hinge member 22 may include a first connection arrangement 70 configured for attachment to a first external member 10 and the second hinge member 42 may include a second connection arrangement 72 configured for attachment to a second external member 12. The second hinge member 42 may comprise first and second sub-portions 62, 64 that are attached together, wherein the first sub-portion 62 includes the first clevis portion 46 extending therefrom and the second sub-portion 64 includes the second clevis portion 48 extending therefrom.

Figure 15:
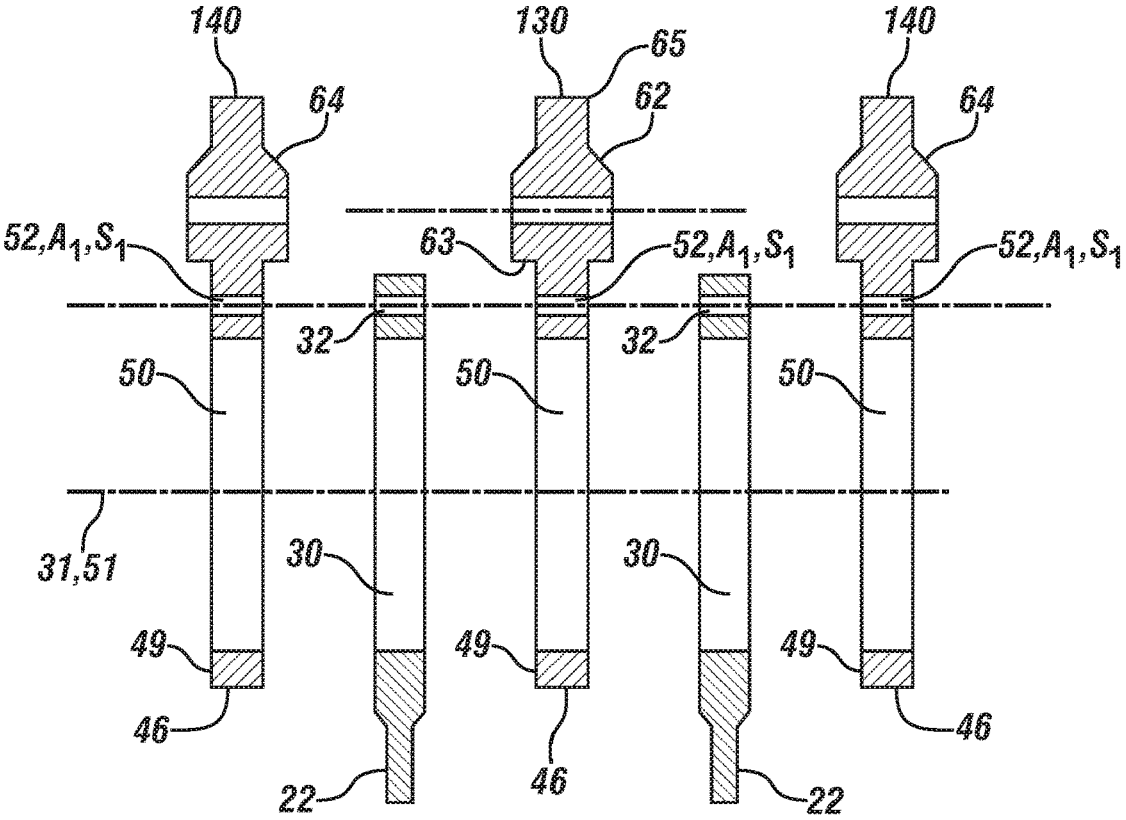
FIGS. 15-16 are unassembled and assembled cross-sectional plan views, respectively, of a stackable hinge assembly.
Figure 16:
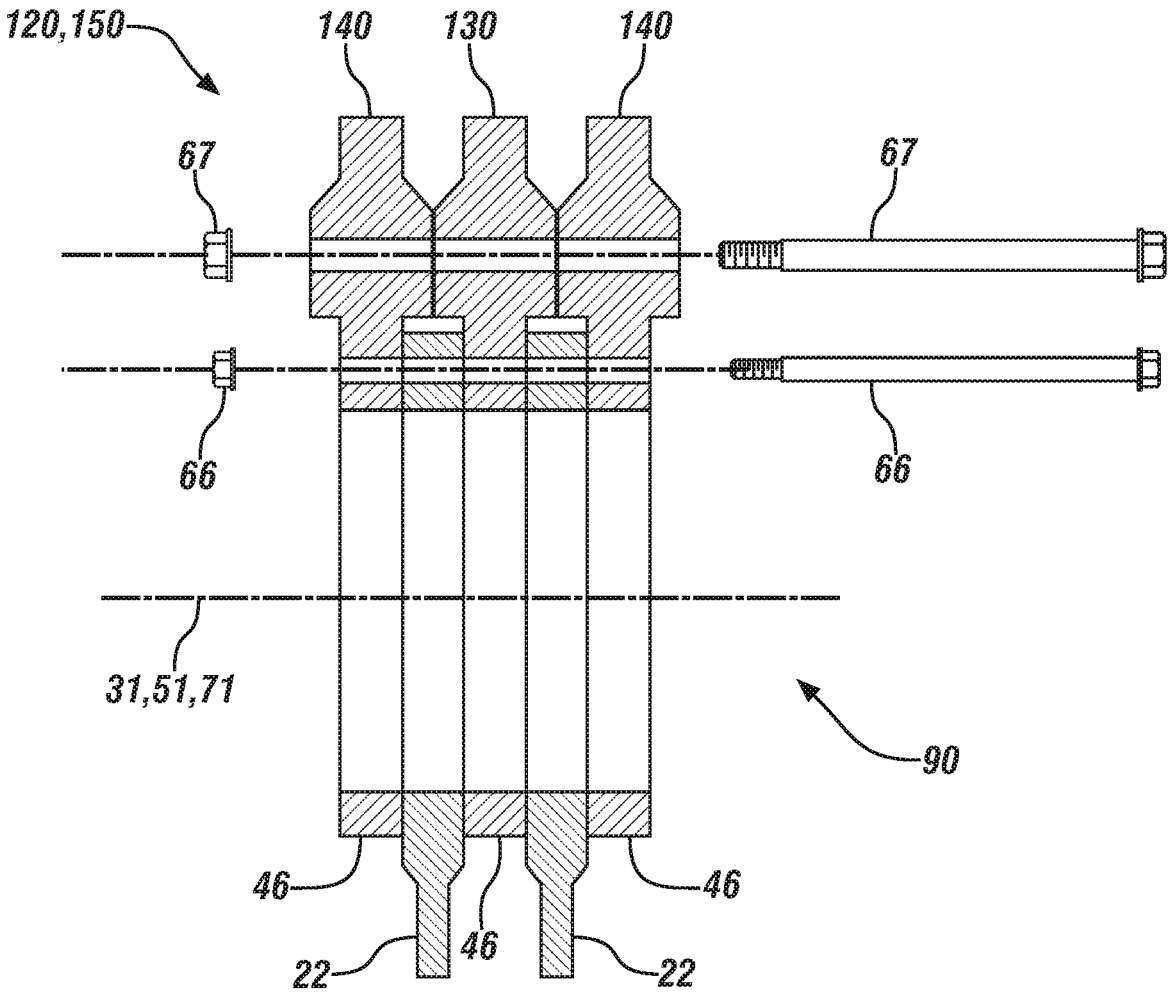

According to yet another embodiment, as illustrated in FIGS. 15-16, a stackable hinge assembly 120 includes a stackable hinge member 130 having a sub-portion 62 with opposed first and second sides 63, 65 and a clevis portion 46 extending from the first side 63. The clevis portion 46 has a distal end 49 with a clevis opening 50 formed therein, and one or more fastening member holes 52 are defined in the clevis portion 46 in a first arcuate array $A_1$ around a first segment $S_1$ of the clevis opening 50. (Note that the first arcuate array $A_1$ and the first segment $S_1$ of FIG. 15 are analogous to the first arcuate array $A_1$ and the second portion $P_2$ of FIG. 5, respectively.) In this embodiment, the sub-portion 62 of the stackable hinge member 130 is configured to be assembled and attached with one or more other sub-portions 64 of other stackable hinge members 140 so as to form a stacked or ganged hinge member arrangement 150.

The stackable hinge assembly 120 may also include one or more additional stackable hinge members 140, for a total of N stackable hinge members 130, 140, wherein the respective sub-portions 62, 64 of the N stackable hinge members 130, 140 are attached together so as to form the stacked hinge member arrangement 150 with N clevis portions 46 extending therefrom and N clevis openings 50 being provided in registration with each other. The stackable hinge assembly 120 may further include N−1 lug members 22 each respectively having opposed first and second major surfaces 26, 28, a lug opening 30, an arcuate guide slot 32 extending around a second segment $S_2$ of the lug opening 30 and having an arcuate guide slot radius $R_{32}$, and an overall thickness T that is equal to or greater than a radial width $W_{32}$ of the arcuate guide slot 32, wherein a total of N−1 lug openings 30 and N−1 arcuate guide slots 32 are provided.

Each of the N−1 lug members 22 may be inserted between a respective neighboring pair of the N clevis portions 46, such that the N clevis openings 50 and the N−1 lug openings 30 are aligned or registered with each other, thereby providing a common open passage 90 therethrough. One or more fastening members 66 may extend into or through the one or more fastening member holes 52 of at least some of the N stackable hinge members 130, 140 and may be slidably received in the arcuate guide slots 32 of the N−1 lug members 22 so as to enable relative rotation between the N stackable hinge members 130, 140 and the N−1 lug members 22 about an axis 71 passing through the clevis openings 50 and lug openings 30. The stackable hinge assembly 120 may further include one or more arcuate bushings 80, each having a respective one or more through-holes 82 defined therein in a second arcuate array $A_2$ which substantially matches the first arcuate array $A_1$. Each arcuate bushing 80 may be disposed within a respective one of the N−1 arcuate guide slots 32 and between a respective neighboring pair of the N clevis portions 46, with the one or more fastening members 66 extending through the one or more through-holes 82 in each arcuate bushing 80.

Figure 17:
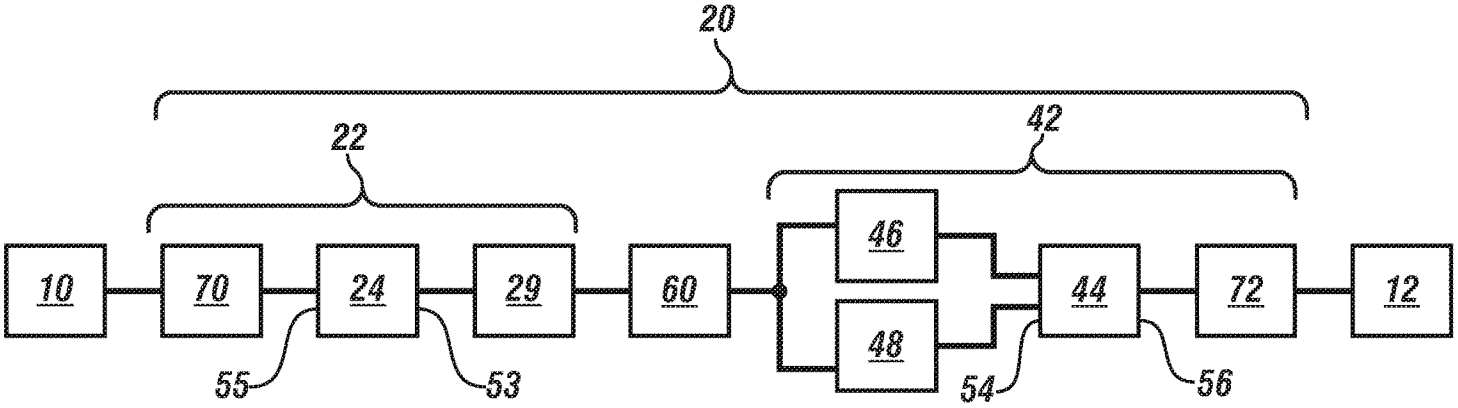
FIGS. 17-18 are schematic block diagrams illustrating the connection of the hinge assembly and stackable hinge assembly, respectively, with various external members.
Figure 18:
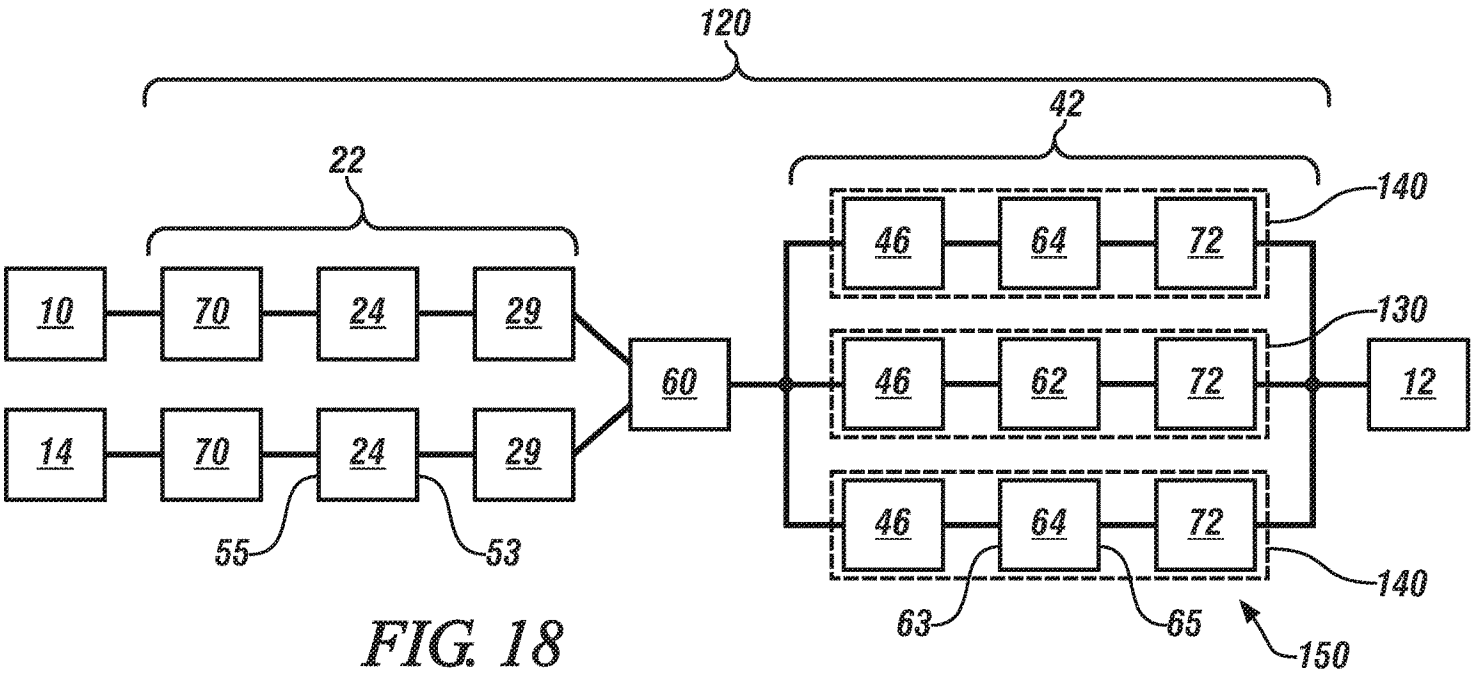

FIGS. 17-18 schematically illustrate the connection of the hinge assembly 20 and stackable hinge assembly 120, respectively, with various external members, such as shafts, beams or other structural members. FIG. 17 shows the first hinge member 22 and the second hinge member 42 being connected to block 60, which represents the capability of providing rotation of the hinge members 22, 42 about a shared or common axis 71 while providing for an opening 90 in the space surrounding the axis of rotation 71. Here, the hinge assembly 20 may be attached to one first external member 10 and to one second external member 12. With these two external members 10, 12 attached to the first and second connection arrangements 70, 72 of the hinge assembly 20, the two external members 10, 12 may rotated with respect to each other about the common rotation axis 71, while the empty space in the opening 90 may be used for passing wires, cables, tubing or other elements therethrough.

In comparison, FIG. 18 shows a stacked or ganged arrangement involving N stackable hinge members 130, 140 and N−1 lug members 22. Here, N=3, since there are two (N−1) lug members 22 and three (N) stackable hinge members 130, 140 that are connected to block 60. (Here, similar to FIG. 17, block 60 represents the capability of providing rotation of the lug members 22 and stackable hinge members 130, 140 about a shared or common axis 71, while providing for an opening 90 in the space surrounding the axis of rotation 71.) Note that solid vertical lines are drawn between the neighboring sub-portions 62, 64, which indicate that the sub-portions 62, 64 are mechanically connected to one another (e.g., via threaded fasteners 67, as in FIG. 16), so as to form a compound clevis member 42 having two or more clevis portions 46. Here, the stackable hinge assembly 120 may be attached to three external members 10, 12, 14; specifically, the first and third external members 10, 14 may each be attached to its own respective first connection arrangement 70, and the second external member 12 may be attached to all of the second connection arrangements 72 of the three stackable hinge members 130, 140. In the arrangement illustrated in FIG. 18, the three external members 10, 12, 14 may be independently rotated with respect to each other about the common rotation axis 71, while the empty space provided in their common opening 90 may be used for passing wires, cables, tubing or other elements therethrough.

The above description is intended to be illustrative, and not restrictive. While the dimensions and types of materials described herein are intended to be illustrative, they are by no means limiting and are exemplary embodiments. In the following claims, use of the terms "first", "second", "top", "bottom", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" and the phrase "A and/or B" should each be understood to mean "only A, only B, or both A and B". Moreover, unless explicitly stated to the contrary, embodiments "comprising" or "having" an element or a plurality of elements having a particular property may include additional such elements not having that property. And when broadly descriptive adverbs such as "substantially" and "generally" are used herein to modify an adjective, these adverbs mean "mostly", "mainly", "for the most part", "to a significant extent", "to a large degree" and/or "at least 51 to 99% out of a possible extent of 100%", and do not necessarily mean "perfectly", "completely", "strictly", "entirely" or "100%".

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. A hinge assembly, comprising:

a first hinge member having opposed first and second major surfaces, a first opening, an arcuate guide slot extending around a first portion of the first opening and having an arcuate guide slot radius, and an overall thickness that is equal to or greater than a radial width of the arcuate guide slot;

a second hinge member having first and second clevis portions with a respective second opening formed through each of the first and second clevis portions, and one or more fastening member holes defined in one or both of the first and second clevis portions and arrayed in a first arcuate array around one or both of the second openings, wherein the first arcuate array has a first arcuate array radius corresponding to the arcuate guide slot radius;

wherein the first hinge member is inserted between the first and second clevis portions with the first and second openings aligned with each other; and one or more fastening members extending into or through the one or more fastening member holes and being slidably received in the arcuate guide slot so as to enable relative rotation between the first and second hinge members about an axis passing through the first and second openings.

2. The hinge assembly of claim 1, wherein an arcuate inner wall extends outward from each of the first and second major surfaces and is disposed between the first opening and the arcuate guide slot, and wherein an arcuate outer wall extends outward from each of the first and second major surfaces and is disposed radially outward of the arcuate guide slot.

3. The hinge assembly of claim 2, wherein the arcuate inner and outer walls extend to a first height outward from the first major surface and to a second height outward from the second major surface, and wherein the overall thickness of the first hinge member comprises the first height plus the second height plus a first thickness as measured between the first and second major surfaces.

4. The hinge assembly of claim 1, wherein the one or more fastening members includes one or more raised bosses integrally formed on one of the first and second clevis portions and extending through the arcuate guide slot and into or through the one or more fastening member holes defined in the other of the first and second clevis portions.

5. The hinge assembly of claim 1, wherein the one or more fastening members includes one or more fasteners extending through a first plurality of the fastening member holes defined in one of the first and second clevis portions, through the arcuate guide slot, and into or through a second plurality of the fastening member holes defined in the other of the first and second clevis portions.

6. The hinge assembly of claim 2, wherein the arcuate inner and outer walls extend along a full arc length of the arcuate guide slot.

7. The hinge assembly of claim 1, further comprising:

one or more arcuate bushings each having a respective one or more through-holes defined therein in a second arcuate array which substantially matches the first arcuate array, wherein each arcuate bushing is disposed within the arcuate guide slot and between the first and second clevis portions, and wherein the one or more fastening members extend through the one or more through-holes.

8. The hinge assembly of claim 1, wherein the first hinge member includes a first connection arrangement configured for attachment to a first external member and the second hinge member includes a second connection arrangement configured for attachment to a second external member.

9. The hinge assembly of claim 8, wherein the first and second clevis portions are formed on a first side of the second hinge member and the second connection arrangement is formed on a second side of the second hinge member opposite the first side.

10. The hinge assembly of claim 1, wherein the axis passes through a center of both the arcuate guide slot radius and the first arcuate array radius.

11. The hinge assembly of claim 1, wherein the second hinge member comprises first and second sub-portions that are attached together, and wherein the first sub-portion includes the first clevis portion extending therefrom and the second sub-portion includes the second clevis portion extending therefrom.

12. A hinge assembly, comprising:

a plate-like first hinge member having opposed first and second major surfaces, a first opening, an arcuate guide slot extending around a first portion of the first opening and having an arcuate guide slot radius, and an overall thickness that is equal to or greater than a radial width of the arcuate guide slot;

a second hinge member having first and second plate-like clevis portions with a respective second opening formed through each of the first and second clevis portions, and a plurality of fastening member holes defined in the first and second clevis portions in a first arcuate array around a respective second portion of each of the second openings, wherein the first arcuate array has a first arcuate array radius corresponding to the arcuate guide slot radius;

wherein the first hinge member is inserted between the first and second clevis portions with the first and second openings aligned with each other; and a plurality of fasteners extending through the fastening member holes and being slidably received in the arcuate guide slot so as to enable relative rotation between the first and second hinge members about an axis passing through the first and second openings and through a center of the arcuate guide slot radius and of the first arcuate array radius.

13. The hinge assembly of claim 12, wherein an arcuate inner wall extends outward from each of the first and second major surfaces and is disposed between the first opening and the arcuate guide slot, and an arcuate outer wall extends outward from each of the first and second major surfaces and is disposed radially outward of the arcuate guide slot, wherein the arcuate inner and outer walls extend to a first height outward from the first major surface and to a second height outward from the second major surface, and wherein the overall thickness of the first hinge member comprises the first height plus the second height plus a first thickness as measured between the first and second major surfaces.

14. The hinge assembly of claim 12, further comprising:

an arcuate bushing having a plurality of through-holes defined therein in a second arcuate array which substantially matches the first arcuate array, wherein the arcuate bushing is disposed within the arcuate guide slot and between the first and second clevis portions, and wherein the plurality of fasteners extend through the plurality of through-holes.

15. The hinge assembly of claim 12, wherein the first hinge member includes a first connection arrangement configured for attachment to a first external member and the second hinge member includes a second connection arrangement configured for attachment to a second external member.

16. The hinge assembly of claim 12, wherein the second hinge member comprises first and second sub-portions that are attached together, and wherein the first sub-portion includes the first clevis portion extending therefrom and the second sub-portion includes the second clevis portion extending therefrom.

17. A stackable hinge assembly, comprising:

a stackable hinge member having a sub-portion with opposed first and second sides and a clevis portion extending from the first side, wherein the clevis portion has a distal end with a clevis opening formed therein, and wherein one or more fastening member holes are defined in the clevis portion in a first arcuate array around a first segment of the clevis opening;

wherein the sub-portion of the stackable hinge member is configured to be attached with one or more other sub-portions of other stackable hinge members so as to form a stacked hinge member arrangement.

18. The stackable hinge assembly of claim 17, further comprising:

one or more additional stackable hinge members, for a total of N stackable hinge members, wherein the respective sub-portions of the N stackable hinge members are attached together so as to form the stacked hinge member arrangement with N clevis portions extending therefrom and N clevis openings being provided in registration with each other.

19. The stackable hinge assembly of claim 18, further comprising:

N−1 lug members each respectively having opposed first and second major surfaces, a lug opening, an arcuate guide slot extending around a second segment of the lug opening and having an arcuate guide slot radius, and an overall thickness that is equal to or greater than a radial width of the arcuate guide slot, wherein a total of N−1 lug openings and N−1 arcuate guide slots are provided;

wherein each of the N−1 lug members is inserted between a respective neighboring pair of the N clevis portions, such that the N clevis openings and the N−1 lug openings are aligned with each other; and one or more fastening members extending into or through the one or more fastening member holes of at least some of the N stackable hinge members and being slidably received in the arcuate guide slots of the N−1 lug members so as to enable relative rotation between the N stackable hinge members and the N−1 lug members about an axis passing through the clevis openings and lug openings.

20. The stackable hinge assembly of claim 19, further comprising:

one or more arcuate bushings each having a respective one or more through-holes defined therein in a second arcuate array which substantially matches the first arcuate array, wherein each arcuate bushing is disposed within a respective one of the N−1 arcuate guide slots and between a respective neighboring pair of the N clevis portions, and wherein the one or more fastening members extend through the one or more through-holes.

* * * * *